US005484065A

United States Patent [19]

Davoli, Jr. et al.

[11] Patent Number: 5,484,065

[45] Date of Patent: Jan. 16, 1996

[54] DRINKING VESSEL-DISPOSABLE TOOTHBRUSH HOLDER

[76] Inventors: Frank Davoli, Jr.; Cherri D. Davoli, both of 17 Milton Ave., West Seneca, N.Y. 14224

[21] Appl. No.: 273,209

[22] Filed: Jul. 11, 1994

[51] Int. Cl.[6] ..... A47B 81/02

[52] U.S. Cl. ..... 211/65; 211/2; 211/70.1; 220/736; 215/390; 248/111

[58] Field of Search ..... 211/2, 65, 66, 211/70.1; 248/111; 206/362.1, 362.2, 362.3, 581, 553; 220/735, 736, 697; 215/390; 229/400, 401, 103; D6/528, 534

[56] References Cited

U.S. PATENT DOCUMENTS

| | | | |
|---|---|---|---|
| 1,946,779 | 2/1934 | Conway | 248/37.3 |
| 2,333,715 | 11/1943 | Hahnemann | 211/70.7 X |
| 2,884,137 | 4/1959 | Lazzaro | 211/65 |
| 4,183,444 | 1/1980 | English et al. | 220/735 X |
| 4,880,020 | 11/1989 | Schurgin | 206/362.3 X |
| 5,007,553 | 4/1991 | Curtis | 220/697 |
| 5,248,081 | 9/1993 | Hook | 229/103 X |

FOREIGN PATENT DOCUMENTS

| | | | |
|---|---|---|---|
| 402674 | 10/1909 | Belgium | 220/736 |
| 1152581 | 9/1957 | France | 248/111 |
| 115303 | 11/1945 | Sweden | 220/735 |

*Primary Examiner*—Alvin C. Chin-Shue
*Assistant Examiner*—Korie H. Chan
*Attorney, Agent, or Firm*—James J. Ralabate

[57] ABSTRACT

This invention provides a disposable drinking vessel that can also be used as a disposable toothbrush holder. The drinking vessel such as a glass or cup has break-through tabs that are located on either or both the bottom base sections or side sections of the vessel. These tabs have slits that can easily be pushed through and a toothbrush holder supported therein. The tabs are leakproof until a pressure is exerted on it to open the slits in the tabs and provide an opening for a toothbrush handle.

8 Claims, 3 Drawing Sheets

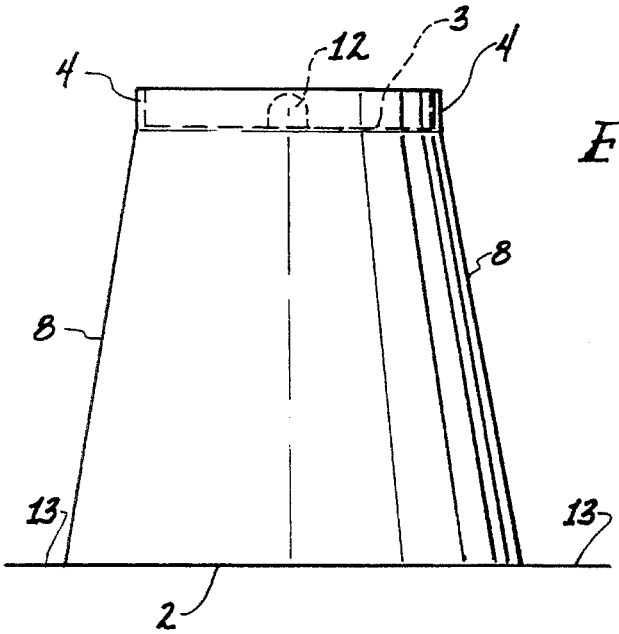
Fig. 4
Fig. 5
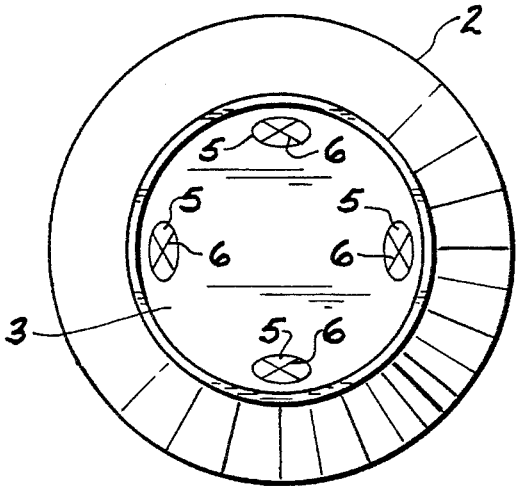
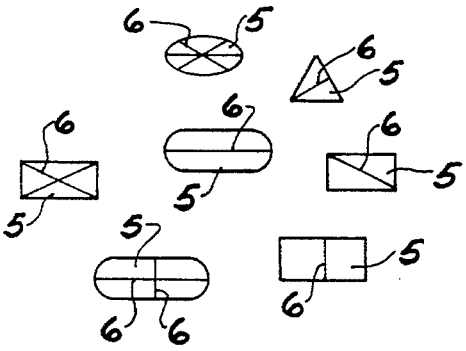
Fig. 6
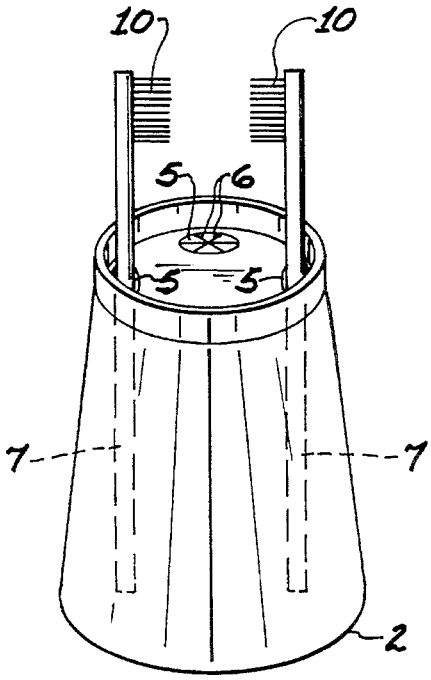
Fig. 7

Fig. 8
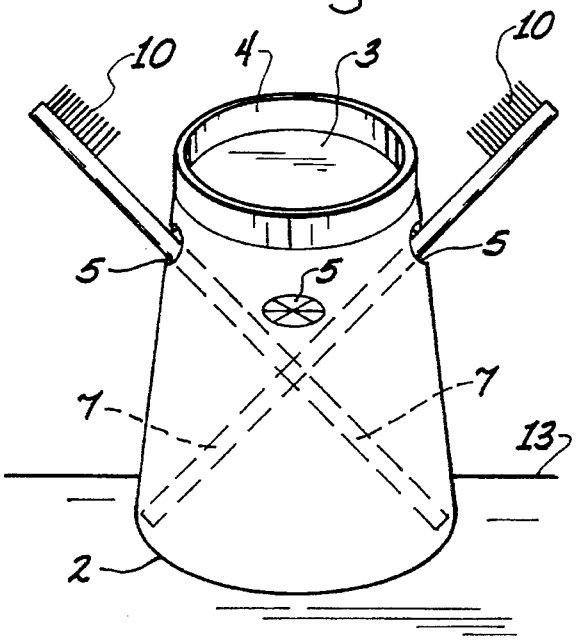
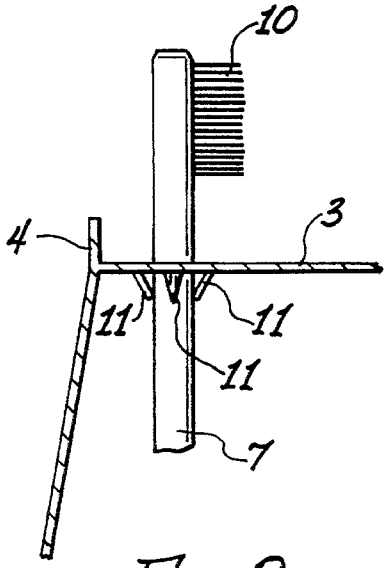
Fig. 9
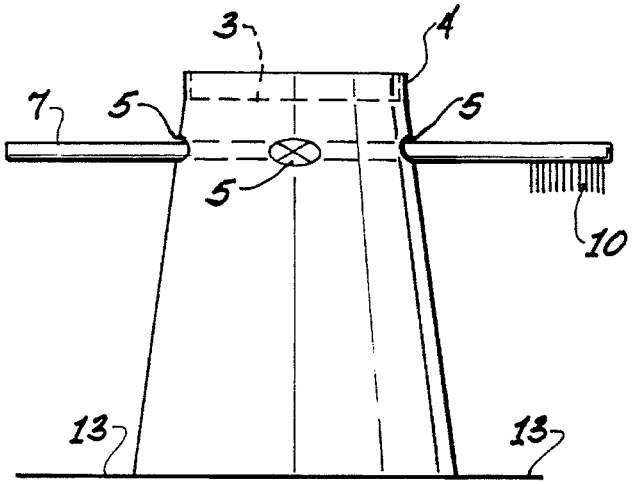
Fig. 10
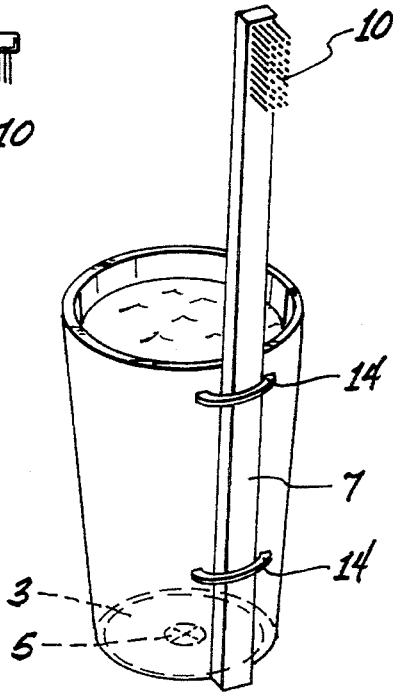
Fig. 11

DRINKING VESSEL-DISPOSABLE TOOTHBRUSH HOLDER

This invention relates to a novel, disposable toothbrush holder and, more particularly, to a disposable drinking vessel-toothbrush holder.

BACKGROUND OF THE INVENTION

Tourists and guests at hotels, motels and patients in hospitals are often confronted with easy contamination of their toothbrushes and other personal items. With the frequency of patient or guest changes and variety of items used in hotel or hospital rooms, the possibility of germs on sinks and adjoining structures is very real. To minimize problems, hospitals and hotels have provided sanitary, wrapped drinking glasses that can be disposed of after singular use. These glasses are generally constructed of an inexpensive plastic material. For convenience of usage and to conserve space, these disposable glasses are usually stacked on a counter adjacent the sinks of the bathrooms. With all of the conveniences offered by hotels, motels and hospitals such as kits containing shampoo, facial soaps, bath caps, hand lotion and toothbrushes, no provision is made for maintaining toothbrushes free from contamination. Closed toothbrush containers do not permit the brush to dry sufficiently between uses. Laying the toothbrush on the counter or sink rim to dry exposes the bristles to germs or contamination that may very likely be present on said counter. Thus, there is a need for an economical and safe way to store a toothbrush after use in these public places and a method that is sanitary and convenient to both the hotel and user.

There have been several attempts at providing disposable toothbrush holders for use in rooms of hotels, inns, motels and hospitals. Some of these holders are described in U.S. Pat. Nos. 1,972,532; 2,177,455; 3,099,273; 3,344,930; 3,794,181 and 4,770,379.

In U.S. Pat. No. 1,972,532 (McMillan), a toothbrush holder is disclosed that is constructed of paper and can be mounted on a wall of a hotel room. The holder is generally shaped like a bracket having an L-shape and adapted to be secured to a lavatory wall or fixture. The concept is to use a disposable holder that can be changed each day by the attendant cleaning the room. Accommodations have to be made to use this type bracket in order to have a locus to hang or secure the holder. Hotel rooms are not now able to accommodate this type toothbrush holder and means would have to be specially installed to use McMillan's holder.

U.S. Pat. No. 2,177,455 (Hackett) discloses a rectangular toothbrush and paste container that can be placed in a glass or other structure. The structure of Hackett encloses the head of a toothbrush when in storage and is removed for use. However, again, the brush is not permitted to dry properly after use and requires a user to carry his or her own closure to a hotel or other public place. Also, if a hotel room has one or two glasses, using one or both to hold a toothbrush prevents the glass from being used for its intended purpose.

The patent to Reed U.S. Pat. No. 3,099,273 describes a container for toothbrushes that can be used as a drinking glass. The Reed container has a top and bottom portion which fit together. A separable ring fits into the container for holding toothbrushes. The ring contains a plurality of slots into which the handle of toothbrushes are placed. Also, a large inner slot is positioned in the ring for holding toothpaste. This Reed container must be carried by the user and cleaned after each use to maintain its sanitary condition. The Reed container is not disposable and does not permit adequate drying of the bristles after use.

Merkel U.S. Pat. No. 3,344,930 teaches the use of a toothbrush holder that is disposable but relatively complex. The Merkel holder is made up of a tray portion with an elongated cavity and upstanding side walls to hold a toothbrush or toothbrushes. A tube of toothpaste can be supported on the tray portion of Merkel's device. While Merkel's device is disposable it is relatively complex and expensive for a disposable item. In addition, Merkel's device must be carried by the user to the hotel or the hotel (or other public place) must supply each room with a number of these supports. Merkel's device cannot be used as a beverage container and cannot be stacked in a hotel room for later usage.

Canham's U.S. Pat. No. 3,794,181, like McMillan above described, requires installation on a wall of a motel, hotel, hospital or other guest room. Each holder of Canham has a replaceable disc that is changed for the next guest to occupy the room. Each disc has a number of slots to hold toothbrushes or a mixture of slots and holes to contain the stem of toothbrushes. Each disc must be attached to the wall mounted bracket by the use of apertures located through each disc. To remove, the discs are fractured by the room attendant or maid and a new disc replaced therein. While the discs are disposable, they must be manufactured specifically for use with the mounting bracket and they must be removed and replaced on this same mounting bracket.

In U.S. Pat. No. 4,770,379 (Estvold), a toothbrush holder is formed from a sheet of paper or other material. Each hotel guest is given a laid-out flat card or paper with a fold and apertured configured structure. The guest then folds and constructs the holders as he or she requires them. This holder must be designed and manufactured especially for guest room usage and requires assembly by the guest or by the room maid or attendant.

In summary, none of the above can be used as both a beverage container and toothbrush holder that would be conveniently used by hotels, hospitals, etc.

SUMMARY OF THE INVENTION

It is therefore an object of this invention to provide a disposable toothbrush holder devoid of the above-noted disadvantages.

Another object of this invention is to provide a combination drinking vessel-toothbrush holder which is readily available in existing hotel, motel or hospital rooms.

A further object of this invention is to provide a disposable item that can be used both as a drinking vessel and a toothbrush holder.

Still a further object of this invention is to provide a disposable toothbrush holder that can be made from existing inexpensive disposable glasses already provided in rooms of hotels, etc.

Yet another object of this invention is to provide an inexpensive yet sanitary disposable toothbrush holder that can be conveniently supplied in hotel, motel and hospital rooms.

Yet still a further object of this invention is to provide a toothbrush holder that does not require assembly or removal from a wall-mounted bracket.

A still yet further object of this invention is to provide a disposable toothbrush holder that can easily be provided in each room and which will remain relatively sanitized for an extended period until or before usage.

These and other objects of this invention are accomplished by providing a plastic or paper drinking cup or glass or other vessel having break-through slots on the base or side portions of the vessel. Plastic cups already provided by most hotels that are plastic wrapped can be easily modified to contain these break-through portions that will open when pressure is applied thereto and a toothbrush handle extended therethrough. These weakened break-through portions or slots are secured enough to be leakproof when the vessel is used as a drinking vessel but will easily break through upon the application of sufficient pressure thereto. The vessel is of course leakproof only until the break-through areas or tabs are opened. The break-through areas can be easily provided in the base or bottom portion of the vessel or on the side of a bottom portion of the vessel. It is preferred that the break-through sections be on the base portion of the plastic vessel or glass for better balance of the brushes when inserted therein. Existing disposable frusto-conical or cylindrical glasses or any other configured cups already supplied by hotels, hospitals or motels, etc. can continue to be supplied and manufactured "as is" except puncture-through or break-through sections can be punched into the vessel during its manufacture step. These disposable vessels are usually made from polyethylene, foams or other non-toxic plastics, paper or other suitably disposable, inexpensive materials. The break-through slots should be just large enough to permit a toothbrush handle to be guided therethrough. The break-through slots may take on any convenient break-through configuration such as a single slit, an X-formed slit, a star-formed slit, combination thereof and the like. Each of these slot formations will result in tabs of the break-through portions pressing against the brush handle to hold it in place after the perforation or break-through is made and penetration by the brush handle. In this way, the disposable glass can be used as a drinking vessel when the glass is in the "upright" position and can be used as a toothbrush holder when the glass is "inverted" and punctured. The "upright" position indicates that the glass's open face side is up, the "inverted" position indicates that the base is up and the open side or face is down against a support such as a counter, table, etc. As earlier noted, the break-through tabs or slots or areas can be located on the base or bottom portion of the vessel or glass or on the side near the bottom portion of the glass or on both the bottom and side portions.

BRIEF DESCRIPTION OF THE DRAWINGS

FIG. 4 is a side plan view of a vessel-holder useful in the present invention having a raised rim portion.

FIG. 5 is a top plan view of an inverted vessel-holder with the base portion up and having four break-through areas therein.

FIG. 6 are plan views of various and typical break-through slots useful in the present invention.

FIG. 7 is a perspective view of the vessel-holder of this invention when used as a toothbrush holder with break-through slots at the bottom section of the vessel.

FIG. 8 is a perspective view of the vessel-holder of this invention when used as a toothbrush holder with break-through slots at the side sections of the vessel.

FIG. 9 is a plan view of the break-through slot after its rupture and the insertion of a toothbrush therethrough.

FIG. 10 is a perspective view of the drinking vessel-toothbrush holder of this invention where the toothbrush is held horizontally in the vessel.

FIG. 11 is a perspective view of an additional brush holding feature that can be added to the vessel of this invention.

DETAILED DESCRIPTION OF THE DRAWINGS AND PREFERRED EMBODIMENTS

Figure 1:
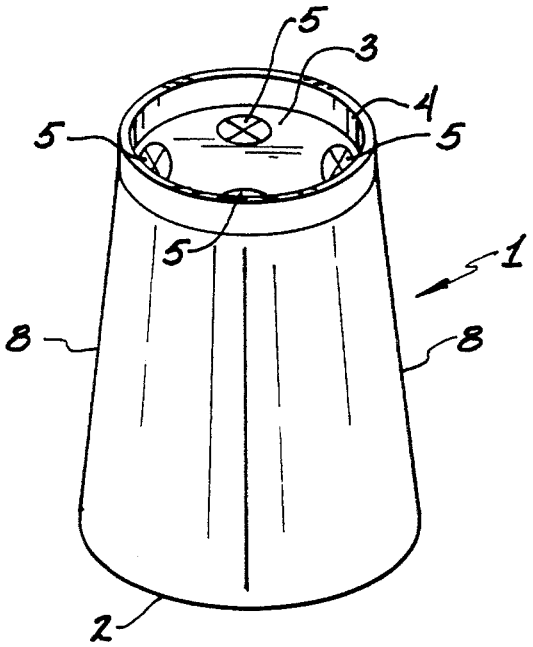
FIG. 1 is a top perspective view of the vessel-toothbrush holder of this invention with break-through slots, portions or tabs at the base or bottom portion of the vessel.

In FIG. 1 a plastic, paper or other disposable type drinking vessel 1 is illustrated with its open face or mouth contacting section 2 facing downward and its base or bottom section 3 facing upwards. A rim 4 is usually positioned around the base periphery but is not necessary for the present invention. Within the rim 4 in the inner portion of base section 3 are one or more breakable or break-through tabs, slots or areas 5. These slots 5 can also be located in the bottom side sections 8 of the vessel 1 if desirable. These slots 5 can be positioned so that the toothbrush will extend horizontally rather than vertically. This would require slots in horizontal alignment as shown in FIG. 10. These breakable areas 5 are sufficiently strong and liquid-proof to hold liquid in the vessel 1 when upright, (section 2 up and section 3 down) when the vessel 1 is used for a drinking glass or cup. However, these break-through tabs or slots 5 are easily pushed open by a toothbrush handle 7 when vessel 1 is used as a toothbrush holder as shown in FIGS. 1–5 and 7–9. The breakable tabs 5 can be of any suitable configuration including those configurations shown in FIG. 6. These tabs 5 can be easily pressed into the vessel 1 during the manufacturing steps of the vessels and would not involve any complicated or extended changes in the manufacturing processes. The slits 6 put in each slot or tab 5, as earlier noted, must be sufficiently strong to remain intact and liquid-proof when vessel 1 is used to contain water or other liquids. By merely pressing an object such as the end of a toothbrush handle on each tab 5, they will easily open to permit the toothbrush handle 7 to be passed therethrough as shown in FIGS. 7, 8 and 9.

Figure 2:
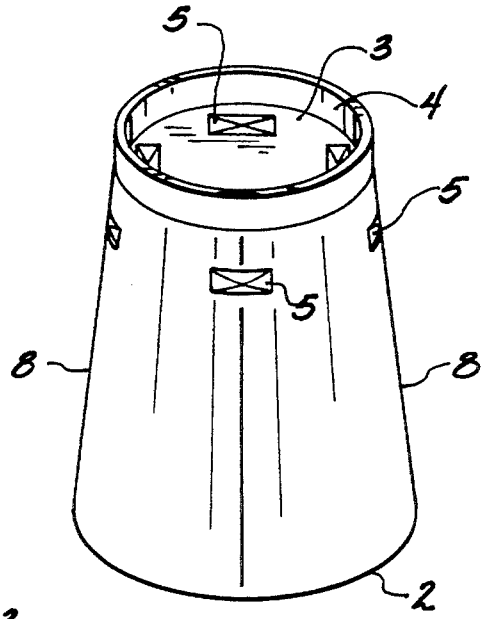
FIG. 2 is a top perspective view of the vessel-holder of this invention with break-through portions, slots or tabs at both the bottom and side portions of the vessel.
Figure 3:
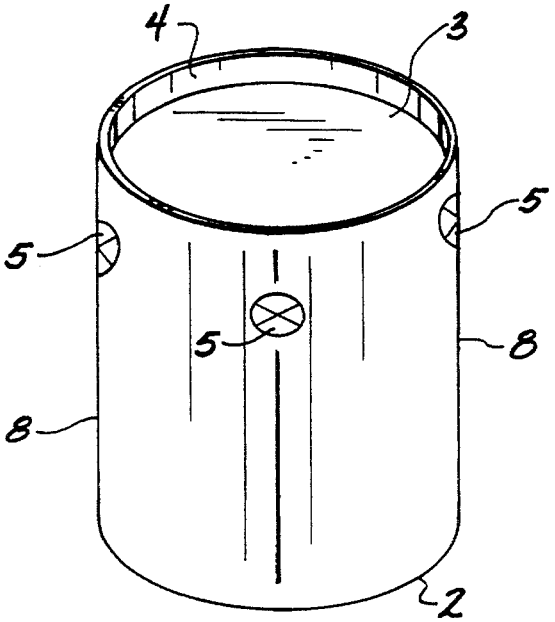
FIG. 3 is a top perspective view of the vessel-holder of this invention with break-through slots, portions or tabs on the side portion of the vessel.

In FIG. 2 break-through slots 5 are shown in both the bottom section 3 and side sections 8, whereas in FIG. 3 these breakable tabs or slots 5 are located only on side sections 8. If the slots 5 are located on side sections 8 of vessel 1, they can be located close to bottom sections 3 for better toothbrush balance when the toothbrush or brushes are extended therethrough but can be located anywhere desired on the side. The tab or slot 5 configurations can be oval, round, square, rectangular, triangular or any other configuration that is convenient. In FIG. 1 they are shown as having an oval configuration, in FIG. 2 tabs 5 are shown to be square or rectangular and in FIG. 3 they are shown to be circular, however, any convenient form can be used. Also, any number of slots or tabs 5 that are one or greater than one can be used in each vessel 1. Also, any number of fold-up loops 14 (as shown in FIG. 11) may be used, i.e., one or greater. It is preferred to use only slots 5 but loops 14 may be used if desired.

In FIG. 5 a plan top view of the vessel-holder 1 of this invention is shown having four tabs 5 with X-formed slits 6. The slits 6 are frangible and, when opened, each V-shaped slit section 11 resulting will press against the toothbrush handle (as shown in FIG. 9) to hold the toothbrush securely in place. The bristle portion 10 is exposed to the atmosphere where it can conveniently dry before its next use. The bristle portion 10 is naturally of a greater cross-sectional area than the openings in slot 5 and therefore will support the toothbrush therein without falling through. In FIG. 6 various tab or slot 5 configurations are shown, however, as earlier noted, any suitable configuration can be used conditioned upon the tab slits 6 being sufficiently strong and leak-proof when used as a drinking vessel and sufficiently frangible when used as a toothbrush holder. An aperture 12 can be used (as shown in FIG. 4) to hold a toothpaste cap, if desired, but it is not necessary to the invention that an aperture 12 be used.

In FIG. 10 a vessel-toothbrush holder 1 is shown where the break-through slots 5 are positioned in the side portions 8 of the vessel in substantial alignment (can be out of alignment also), if desired, so that the toothbrush handle 7 extends horizontally through the width of vessel 1. If desirable, a plurality of slots 5 can be positioned anywhere in side portions 8 so that several toothbrushes can extend therethrough at different levels or planes above the supporting surface 13 such as a vanity or table top.

In FIG. 11 a vessel-toothbrush holder 1 is illustrated having fold-up or fold-down loops 14 which can be used alone or together with slots 5 to hold a toothbrush (or brushes) handle 7. These loops 14 resemble a fold-out loop used on paper coffee cups to provide a handle except that loop apertures 15 in the present invention are not vertical or perpendicular but rather substantially horizontal or parallel to a supporting surface. While any additional brush-holding means can be used with slots 5, it is highly preferred to use just slots 5 in a vessel without any additional means to hold a brush.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A sanitary, disposable drinking vessel convertible to a disposable toothbrush holder which comprises an open top section, side sections and a bottom base section to define thereby a reservoir for holding a liquid, said vessel thereby having means to hold a liquid therein in a leakproof fashion, said vessel containing at least one break-through tab in at least said bottom base section or said side sections, said break-through tabs having slits therein which can be opened by pressure exerted thereon, said tabs being of sufficient dimension to hold a handle of a toothbrush therethrough, said vessel when in an upright position being usable in its entirety as a disposable leakproof drinking vessel and said vessel when in an inverted position and when break-through tabs are opened being usable thereafter as a disposable toothbrush holder.

2. The vessel of claim 1 wherein said vessel contains break-through tabs on said bottom base section.

3. The vessel of claim 1 wherein said vessel contains break-through tabs or slots on said side sections.

4. The vessel of claim 1 wherein said vessel contains break-through tabs or slots on both said side and bottom base sections.

5. The vessel of claim 1 wherein said vessel contains at least two of break-through tabs or slots.

6. The vessel of claim 1 wherein said vessel is constructed of a disposable material.

7. The vessel of claim 1 wherein said vessel has a frusto-conical configuration.

8. The vessel of claim 1 wherein said vessel has a cylindrical configuration.

* * * * *